United States Patent [19]

Miller

[11] 4,411,621

[45] Oct. 25, 1983

[54] FURNACE WALL CONSTRUCTION

[76] Inventor: Thomas M. Miller, 26027 Byron Dr., North Olmsted, Ohio 44070

[21] Appl. No.: 320,861

[22] Filed: Nov. 16, 1981

Related U.S. Application Data

[63] Continuation-in-part of Ser. No. 213,557, Dec. 5, 1980, abandoned.

[51] Int. Cl.[3] ..... F27D 1/00; F23M 5/00

[52] U.S. Cl. ..... 432/247; 110/336; 110/331; 52/574; 266/283

[58] Field of Search ..... 110/336, 338, 339, 331, 110/332; 266/283; 52/574, 579; 432/247

[56] References Cited

U.S. PATENT DOCUMENTS 4,336,086 6/1982 Rast ..... 110/336

FOREIGN PATENT DOCUMENTS 2832081 11/1979 Fed. Rep. of Germany ..... 110/336
2004626 4/1979 United Kingdom .
2034867 10/1979 United Kingdom ..... 110/336

*Primary Examiner*—Henry C. Yuen
*Attorney, Agent, or Firm*—Body, Vickers & Daniels

[57] ABSTRACT

A forge furnace chamber has rear, side and top walls each defined by an expanded sheet metal member and U-shaped mats of ceramic fiber insulating material supported thereon. First ones of the U-shaped mats have the closed ends thereof abutting the corresponding expanded sheet metal member with the legs of each mat extending inwardly of the chamber, and second ones of the mats have their closed ends facing inwardly of the chamber with the legs of each mat receiving the adjacent legs of an adjacent pair of the first mats therebetween, whereby the closed ends of the second mats extend across the inner ends of the adjacent legs of the first mats. The interleaved mats of insulating material are supported on the corresponding expanded sheet metal member by metal rods extending between the legs of the first mats adjacent the closed ends thereof and wire ties fastening the rods to the expanded sheet metal member.

24 Claims, 7 Drawing Figures

FIG. 1
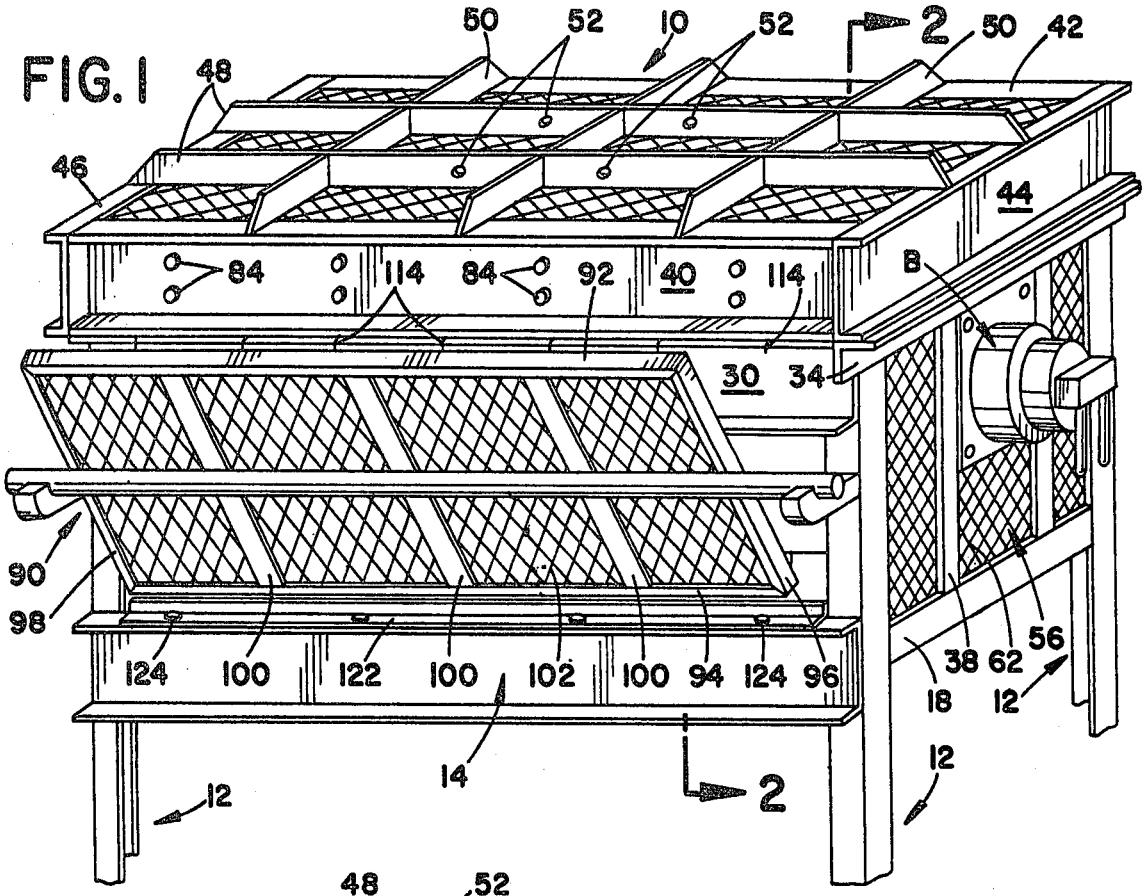
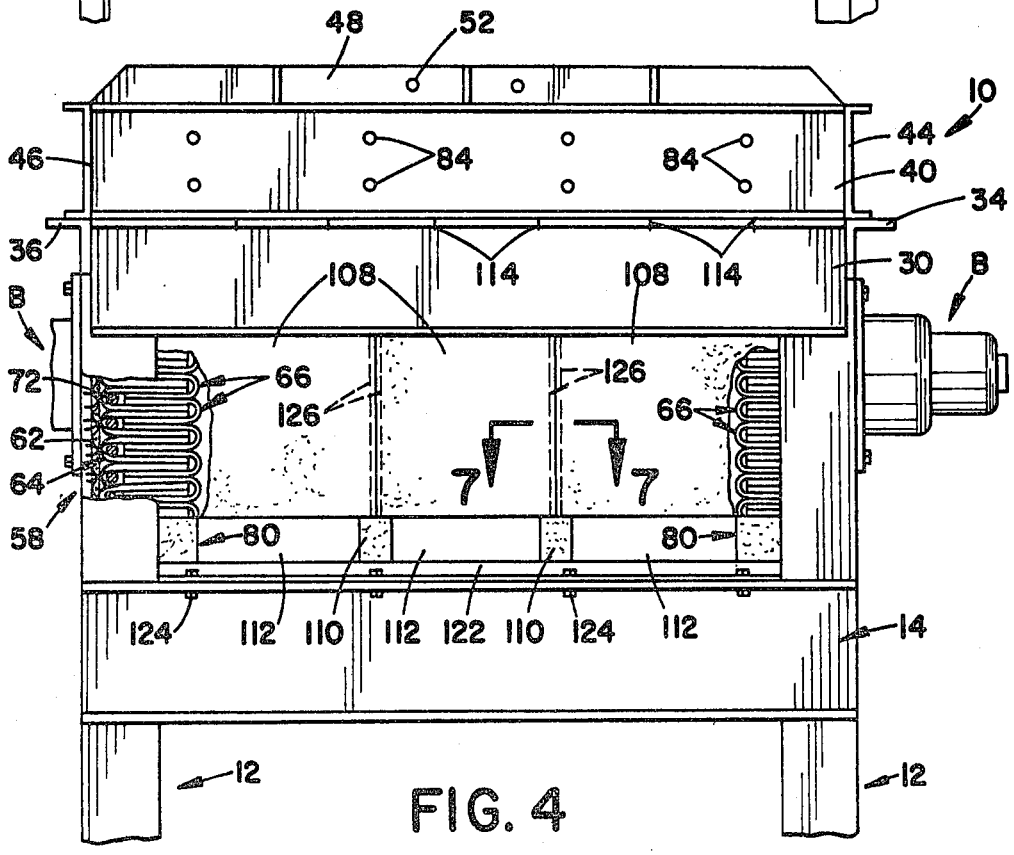
FIG. 4

FIG. 3
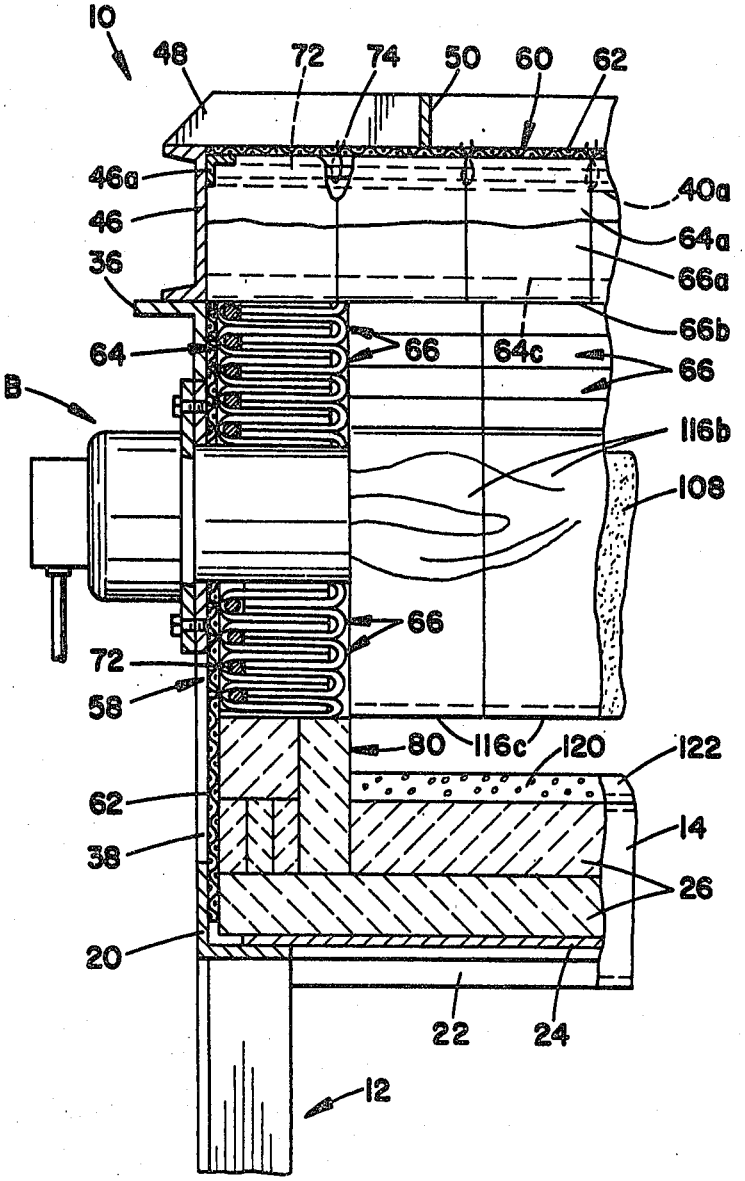
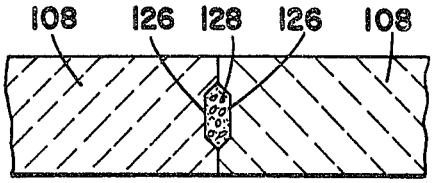
FIG. 7

FURNACE WALL CONSTRUCTION

This application is a continuation-in-part of application Ser. No. 213,557 filed Dec. 5, 1980, now abandoned.

BACKGROUND OF THE INVENTION

The present invention relates to the art of furnaces and, more particularly, to improvements in furnace wall and furnace chamber constructions.

The present invention finds particular utility in connection with the construction of the chamber walls and removable cover of a furnace, such as a forge furnace, and accordingly is disclosed and described in detail herein in connection with such a furnace. At the same time, however, it will be appreciated that a furnace wall construction in accordance with the present invention is adapted to be used in connection with the construction of other types of furnaces as well as the construction of components for use with other types of heating chambers, such as covers for soaking pits for example.

It is of course well known that furnaces, such as forge furnaces, are constructed to provide a refractory lined chamber including a bottom wall, upright front, back and side walls, and a top wall. The bottom, back, side and top walls are defined by corresponding steel plates and linings of refractory fire brick, and the front wall is constructed of refractory material to provide an access opening or openings into the chamber. Such furnace constructions are extremely heavy due to the use of refractory brick and steel plate for the construction thereof and, for reasons including the use of such materials and construction time, are undesirably expensive. Upon start up of the furnace, considerable time is required to heat the fire brick material to reach the operating temperature for the furnace, and the fire brick has a high heat retention characteristic, whereby considerable time is required for the furnace to cool sufficiently following shut down to enable access thereto such as for maintenance. Moreover, when a leakage path occurs across the fire brick lining between the furnace chamber and the steel shell plate as the result, for example, of fractures in the refractory brick and/or the mortared joints therebetween, the shell plate is excessively heated and the heat therein attacks the anchoring for the fire brick. Thus, there is a heat loss across such fractures and potential degrading of the fire brick anchoring, both of which are undesirable and lead to increased operating and maintenance costs. Moreover, such leakage paths can be detected only from within the furnace chamber and can exist for a considerable period of time without being detected. Accordingly, frequent shut down and inspection of the lining within the chamber is necessary in an effort to minimize the latter problems by detecting and repairing fractures from within the chamber. It will be appreciated that such shut down and the time required to locate and repair fractures increases maintenance time and costs and reduces production capabilities with respect to the furnace.

With further regard to such previous furnace constructions, the front wall is generally defined by a laterally extending lintel of cast refractory blocks supported above the floor of the furnace chamber so as to define an elongate opening or openings through which workpieces are introduced into the chamber. The vertical height of such openings is determined by the height of support bricks which underlie the lintel blocks and, heretofore, adjustment of the height of the openings required the use of different size supporting bricks. Such lintel blocks are quite heavy and, accordingly, considerable time and effort is required to change the opening height when it beomes necessary or desirable to do so. Furthermore, in order to enable such manipulation of the lintel blocks, the latter necessarily have open joints therebetween providing leakage paths for heat from the furnace chamber. Still further, the blocks are massive and have a high heat retention characteristic, thus adding to the heating up and cooling down times mentioned above with regard to the fire brick linings of the furnace.

Arrangements have been provided heretofore for replaceing fire brick linings in a steel shell furnace with linings of fibrous insulating material which most often are in the form of modules of given size provided internally of the fibrous material with arrangements for attaching the modules to the steel shell. Examples of such modular constructions for this purpose are shown in U.S. Pat. Nos. 3,832,815; 3,952,470; and 4,287,839. While such use of fibrous insulating material reduces the weight of the furnace lining, it does not enable minimizing the overall weight of the wall or cover component as a result of the fact that the outer side of the furnace wall is still defined by steel plate material. Furthermore, such arrangements do not avoid the problem of hot spots at the shell due to heat paths which may develop across the insulating material, and the fact that such heat paths must be located and repaired from within the furnace. Still further, the assembly procedures with regard to installing modules are time consuming, complex and physically demanding on the part of workers. It has also been proposed heretofore, as shown in U.S. Pat. No. 3,990,203, to construct a heating chamber wall from preformed modules of fibrous insulating material and an expanded metal backing. The modules are provided with embedded anchor strips welded at their opposite ends to side support members, and the expanded metal backing is welded to the anchor strips and faces outwardly of the chamber wall. Wall units thus constructed are clamped together to provide a wall assembly which is supported by connection to support beams. While such an arrangement minimizes weight in a given wall or cover component constructed therefrom, the assembly procedure is still time consuming and expensive, the expanded metal backing does not support the insulation, and the anchoring arrangement does not provide a desired retention capability with respect to maintaining the fibrous insulating material securely in place with respect to the expanded metal member. The latter are extremely important in connection with minimizing or avoiding the creation of heat leakage paths across a heating chamber component, and minimizing maintenance or replacement operations to assure stability of the heating chamber component over periods of extended use.

SUMMARY OF THE INVENTION

In accordance with the present invention, a wall construction for use as a furnace chamber wall or cover, or other heating chamber component such as a soaking pit cover, is constructed in a manner which enables obtaining the advantage of lightness in weight of an assembly of modular fibrous insulating material and an open mesh backing as described above while advantageously avoiding the disadvantages of such previous constructions and the disadvantages of other modular assemblies of fibrous insulating material heretofore provided for lining steel shell furnaces. More particularly in this respect, a heating chamber wall or cover according to the present invention is comprised of an outer side defined by an open metal mesh component and an inner side defined by U-shaped mats of fibrous insulating material supported on the metal mesh component. The open metal mesh component may be expanded sheet metal, woven heavy wire, or the like, and the U-shaped mats are positioned with the bridging portions thereof against the mesh component and are interconnected with the latter by means of elongate support members such as rods or tubes disposed between the legs of the mats adjacent the bridging portions and fastened to the mesh. Preferably, such fastening is achieved by wire ties which extend around the support members and through the mats and mesh and have outer ends which are twisted together exteriorly of the mesh. The support members therefore securely hold the U-shaped mats against the mesh component, preventing separation of the insulating material therefrom. This structural arrangement further advantageously enables a wall or cover component of any given length and width or height dimensions to be more readily and efficiently constructed than similar components heretofore requiring construction through the use of preassembled modules of fibrous insulating material and/or the use of structurally complex or elaborate insulating mat mounting arrangements. In this respect, a mat of desired length and width is quickly folded to the U-shaped configuration about the support member and the latter is readily fastened to the metal mesh component such as by the wire tie elements. Accordingly, it will be appreciated that a wall or cover component is adapted to be constructed working with individual mats of material which can be readily cut to a desired dimension and fastened to the metal mesh component adjacent a previously mounted mat, whereby the construction of a wall or cover component is less demanding physically and, with respect to given peripheral dimensions, can be more quickly completed and more economically constructed by eliminating structurally complex, expensive and/or time consuming fastening arrangements for the mats of insulating material.

Furthermore, in connection with the construction of a furnace such as a forge furnace in which the outer side of a chamber wall is comprised of a $\frac{5}{8}''$ steel shell plate, a $\frac{1}{4}''$ to $\frac{3}{8}''$ expanded sheet metal component employed in accordance with the present invention enables a reduction of about 80% in weight with respect to the steel shell plate alone. This, together with the fact that a fibrous type insulating material is of lighter weight than a refractory brick lining of comparable dimensions, enables the overall weight of a given size furnace to be considerably less than of a refractory brick lined steel shell furnace. Further in connection with heating chamber wall or cover components according to the present invention, the fibrous insulating material provides for the furnace to have a shorter heating up time and a shorter cooling down time than a furnace having a chamber defined by a steel plate shell and a fire brick lining. Importantly too, the open metal mesh outer side of the chamber wall enables visual inspection and thus early detection of any heat path through the insulation from the heating chamber, or other lining problem, and enables the plugging of such heat pths or other repairs to be made from outside the chamber and during operation thereof. In this respect, for example, a piece of the fibrous insulating material or a plug of other materials used in repairing furnace linings can be pushed through the open metal mesh and into the opening defining the heat path. Preferably, the back, side and top walls of a furnace are constructed in the foregoing manner, with the top wall being removeable, and it will be appreciated that the light weight construction facilitates such removal of the top wall to gain access into the interior of the furnace chamber.

Preferably, a wall or cover component according to the present invention is comprised of first and second U-shaped mats of fibrous insulating material, the first of which mats are disposed and supported on the metal mesh component as described above, and the second of which mats have their bridging portions extending across the inner ends of adjacent legs of the first mats with the legs of the second mats disposed between the legs of the first mats and extending from the bridging portions towards the metal mesh component. This arrangement advantageously eliminates any linearly continuous heat path across the wall or cover component. In this respect, the linear heat path between the adjacent legs of adjacent ones of either the first or second mats terminates between the legs of the other mats. Additionally, this arrangement advantageously enables the use of first and second mats respectively of higher and lower thermal conductivity. In connection with a furnace chamber wall, for example, this arrangement provides for obtaining a desired efficiency with respect to heating within the furnace chamber and enables a savings in construction costs in that the insulating material of higher thermal conductivity is less expensive.

Further in accordance with the present invention, vertically shorter lintel blocks can be employed in constructing the front wall of a furnace, such as a forge furnace, and adjustment of the vertical height of the opening into the furnace chamber through the front wall of the furnace is facilitated without disturbing the lintel blocks. This promotes a reduction in weight and cost of the lintel blocks and thus the furnace, and such adjustment of the opening into the chamber enables the provision of a mortared joint between adjacent lintel blocks, thus to seal the joint against leakage of heat thereacross from the chamber. In accordance with another aspect of the invention, the inner sides of the lintel blocks are simply and economically insulated against heat within the furnace chamber, through use of fibrous insulating material, thus to reduce heat build up therein and accordingly the cooling down time following use of the furnace.

It is accordingly an outstanding object of the present invention to provide an improved heating chamber wall or cover structure and an improved furnace construction employing the same.

Another object is the provision of a heating chamber wall or cover component which is light in weight, readily and economically constructed, and which facilitates the detection and repair of leakage paths and other lining problems from outside a heating chamber and during operation thereof.

Yet another object is the provision of a heating chamber wall or cover having an outer side of open metal mesh and an inner side including U-shaped mats of fibrous insulating material disposed with the bridging portions against the metal mesh and retained thereagainst by supporting rods within the bridging portion of the U and fastened to the metal mesh.

Still another object is the provision of a heating chamber wall or cover of the foregoing character wherein the inner side includes second U-shaped mats of fibrous insulating material disposed with the bridging portion of the U extending across the inner ends of the legs of the first mats and with the legs of the second mats extending toward the metal mesh.

A further object is the provision of an improved furnace construction in which the furnace chamber is defined in part by walls of the foregoing character, and which furnace is economical to construct and maintain and is efficient in use.

Yet another object is the provision of a furnace construction of the foregoing character having an opening or openings into the furnace chamber readily adjustable in vertical height from outside the furnace.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a perspective view of a slot-type forge furnace constructed in accordance with the present invention;

FIG. 3 is a cross-sectional elevation view of a portion of the furnace taken along line 3—3 in FIG. 2;

FIG. 4 is a front elevation view of the furnace with the heat shield removed;

DESCRIPTION OF A PREFERRED EMBODIMENT

Figures 2, 6:
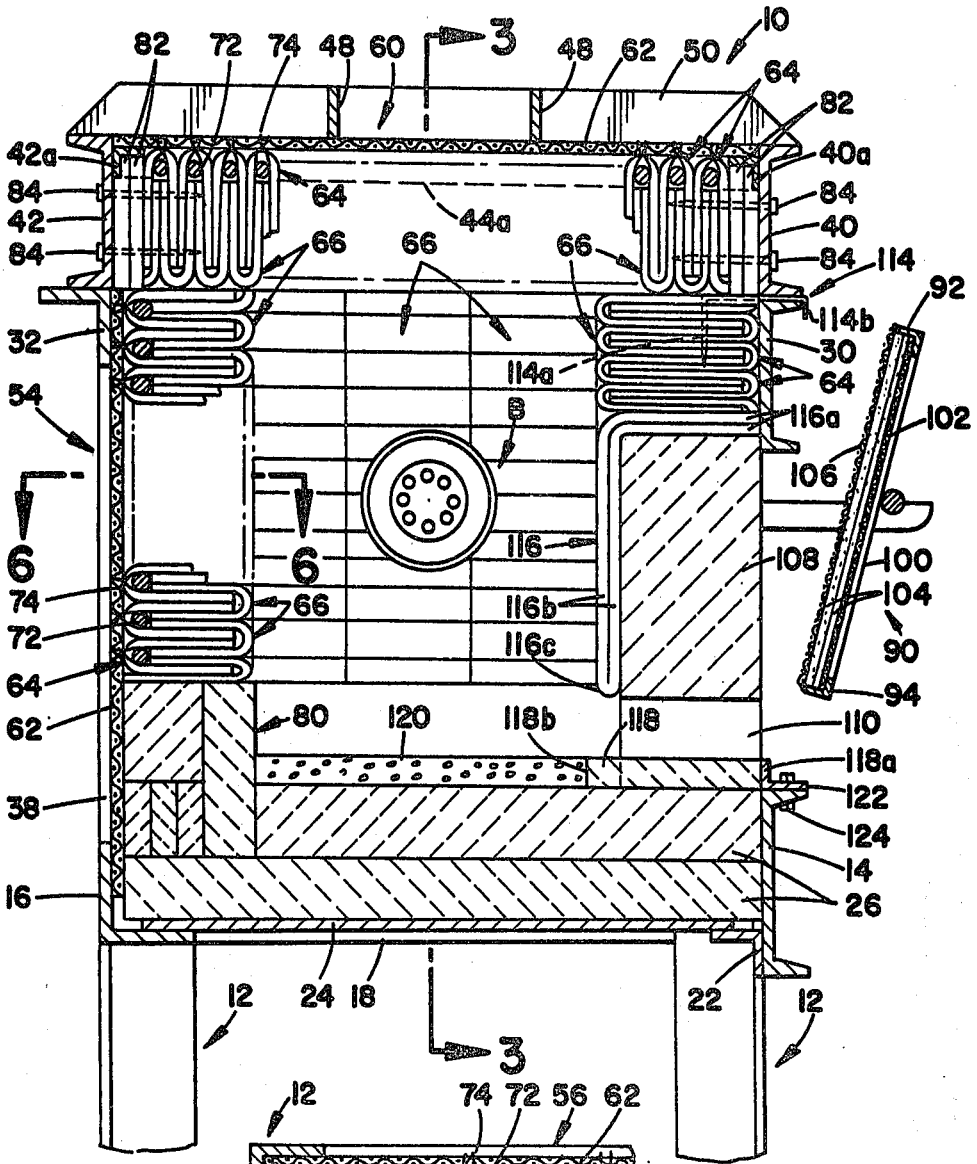
FIG. 2 is a cross-sectional elevation view of the furnace taken along line 2—2 in FIG. 1.
FIG. 6 is a plan view, in section, taken along line 6—6 in FIG. 2 and showing the corner arrangement between the back and side walls of the chamber; and, FIG. 7 is a plan view, in section, taken along line 7—7 in FIG. 4.

Referring now in greater detail to the drawings, wherein the showings are for the purpose of illustrating a preferred embodiment of the invention only, and not for limiting the invention, FIGS. 1-4 illustrate a forge furnace 10 comprised of an open frame structure of welded construction and including upright support legs 12, horizontally extending lower front and rear frame members 14 and 16, respectively, and horizontally extending lower side members 18 and 20. A support member 22 extends along the lower end of front frame member 14 and, together with frame members 16, 18 and 20 supports a steel bed plate 24 which in turn supports refractory brick material 26 defining the bottom wall of the furnace. The frame structure further includes horizontally extending upper front and rear frame members 30 and 32, respectively, at the upper ends of legs 12, and horizontally extending upper side members 34 and 36. Preferably, a plurality of supplementary upright support members 38 are provided between each of the lower support members 16, 18 and 20 and the corresponding one of the upper support members 32, 34 and 36 for the purpose which will become apparent hereinafter. A top frame assembly is removably supported on upper frame members 30, 32, 34 and 36 and includes top frame members 40, 42, 44 and 46 overlying the upper frame members. Frame members 40, 42, 44 and 46 are respectively provided with angle iron support members **40*a*, 42*a*, 44*a* and 46*a* coextensive therewith along the upper inner side edge thereof for the purpose set forth hereinafter. The top frame assembly further includes a pair of support plates 48 extending across the upper ends of members 44 and 46, and a plurality of cross plates 50 extending between the upper ends of frame members 40 and 42 and between plates 48. The top frame assembly rests on the upper ends of the underlying frame members, and any suitable arrangement can be provided to facilitate removing the top frame assembly to provide access to the interior of the furnace. In the embodiment illustrated, support members 48 are provided with openings 52** therethrough to facilitate such removal such as through the use of an overhead crane or the like.

In accordance with the present invention, an open frame structure such as that described hereinabove supports a rear wall assembly 54, side wall assemblies 56 and 58 and a top wall assembly 60, each of which assemblies is comprised of an open metal mesh member 62, preferably of expanded sheet metal, and interleaved first and second U-shaped mats of fibrous insulating material 64 and 66, respectively. Each of the expanded sheet metal members 62 of the back and side wall assemblies extends horizontally and vertically between the corresponding pairs of legs 12 and the corresponding upper and lower support members of the frame assembly, and the sheet metal members are disposed on the inner sides of the frame members and suitably secured thereto such as by welding. The latter expanded sheet metal members are likewise on the inner sides of supplementary support members 38 and may be secured to the corresponding ones thereof such as by welding. The supplementary support members serve to support the expanded sheet metal members against deflection laterally outwardly of the corresponding frame components. Similarly, expanded sheet metal member 62 of top wall assembly 60 extends horizontally between the top frame members 40, 42, 44 and 46 and is secured to angle iron members **40*a*, 42*a*, 44*a* and 46*a* and to the inner sides of support plates 48 and 50**, such as by welding.

Figure 5:
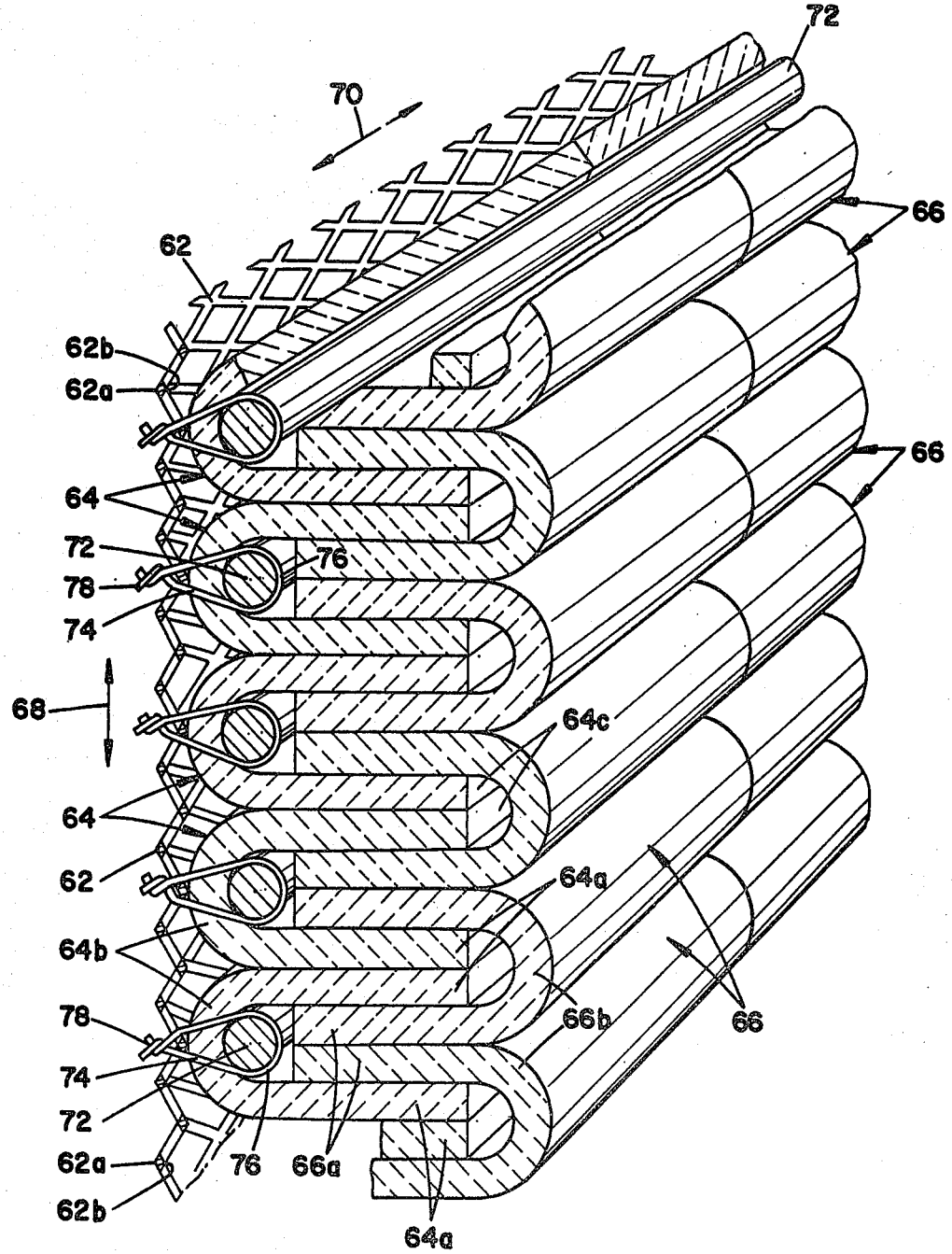
FIG. 5 is an enlarged perspective view of a portion of a furnace wall according to the invention.

Basically, the construction of the back, side and top wall assemblies is the same, whereby it will be appreciated that the following description of the portion of a wall assembly illustrated in FIG. 5 is applicable to the wall assemblies illustrated in FIGS. 1-4. With reference to FIG. 5, together with FIGS. 1-4, it will be seen that each first U-shaped mat 64 has leg portions **64*a* and an integral bridging portion 64*b* between the legs, and that each second U-shaped mat 66 has legs 66*a* and an integral briding portion 66*b* therebetween. In the upright orientation of expanded sheet metal member 62 in FIG. 5, the latter has outer and inner sides 62*a* and 62*b*, respectively, and with regard to a given wall assembly in such orientation it will be appreciated that member 62 in its entirety has horizontally extending upper and lower edges spaced apart in the direction of arrow 68 and vertically extending side edges spaced apart in the direction of arrow 70. With further regard to such orientation of expanded sheet metal member 62, vertically adjacent ones of first mats 64 are disposed with bridging portions 64*b* thereof abutting inner side 62*b* of member 62 and with the planes of legs 64*a* thereof extending inwardly with respect to member 62 in horizontally parallel relationship with respect to one another. Furthermore, adjacent legs 64*a* of vertically adjacent ones of the first mats 64 are juxtaposed with respect to one another and each pair of such adjacent legs 64***a* is received between legs 66*a* of one of the second U-shaped mats 66. Accordingly, the bridging portion 66*b* of the latter mat extends vertically across the inner ends 64*c* of legs 62*a*. Similarly, therefore, adjacent legs 66*a* of vertically adjacent ones of the second mats 66 are disposed between the legs 64*a* of one of the first mats 64.

The interleaved mats 64 and 66 are supported on expanded metal member 62 by means of steel support rods 72 and tie wires 74. More particularly, rods 72 extend horizontally between legs 64*a* of first mats 64 adjacent bridging portions 64*b*, and tie wires 74 have a bight portion 76 extending around the corresponding rod 72 and outer ends 78 which extend through adjacent openings in member 62 and are twisted about one another across a bridging portion between the openings. Rods 72 extend between the opposite ends of member 62 in the direction of the rod axis, and it will be appreciated that each rod 72 supports the corresponding mats 64 vertically relative to expanded metal member 62 and against lateral displacement inwardly thereof. The engagement of legs 66*a* of second mats 66 between the legs of mats 64 provides for mats 66 to be frictionally retained against displacement inwardly with respect to member 62. In connection with a wall having a given dimension transverse to the axes of rods 72, the spacing between rods 72 transverse to the axes thereof, the number of the mats 64 and 66 in the latter direction, and the thickness of the mat material provides for the mats to be somewhat compressed so as to optimize such frictional retention. As will be appreciated from FIGS. 2–5, mats 64 and 66 of the wall assemblies are provided in axially adjacent sections with regard to the direction of the axes of support rods 72, whereby a given wall in the furnace is comprised of a plurality of rows of mats 64 and 66 in which each row is transverse to the rod axes and the rows are axially adjacent with respect to the rod axes. Such axially adjacent sectional configuration advantageously provides for the tie wires 74 to extend outwardly between the mats of adjacent rows and facilitates assembly of a given wall. However, it will be appreciated that the mats could be continuous in the direction of the rod axes and that the fibrous character of the mats permits penetration of the tie wires therethrough for fastening rods 72 to member 62.

With the foregoing basic wall construction in mind, and with reference again to FIGS. 1–4, it will be appreciated that the expanded sheet metal member 62 of each of the side wall assemblies 56 and 58 is provided with an opening therethrough to receive the inner end of a burner unit B which is suitably mounted on the corresponding side wall for heating the inside of the furnace chamber in a well known manner. It will likewise be appreciated that support rods 72 or side wall assemblies 56 and 58 in the vertical area of the corresponding burner unit are interrupted to enable the burner unit to extend through the wall assembly. With further regard to the furnace construction, and particularly back wall assembly 54 and side wall assemblies 56 and 58, fire brick curbs 80 are preferably provided about the periphery of the bottom wall of the furnace chamber to extend upwardly of the chamber floor, thus to avoid damaging the fibrous insulating material of the back and side walls assemblies by workpieces introduced into the furnace. Accordingly, the bottom most ones of second mats 66 of each of the wall assemblies 54, 56 and 58 engages against the upper surface of the corresponding curb 80. In order to avoid leakage paths across the juncture between back wall assembly 54 and side wall assemblies 56 and 58, corner constructions are provided therebetween as shown in FIG. 6 of the drawing. In this respect, the endmost vertical row of mats 64 and 66 of back wall assembly 54 is provided with a vertically extending recess defined by walls 86 and 87, and the endmost vertical row of mats 64 and 66 of side wall assembly 56 is provided with a vertically extending recess defined by walls 88 and 89. These recesses provide for the adjacent rows of mats in the corner to interengage along a generally Z-shaped path between the furnace chamber and the exterior of the chamber, thus to close the corner against the loss of heat thereacross. It will be appreciated that the corner between back wall assembly 54 and side wall assembly 58 is similarly constructed.

With regard to top wall assembly 60, it will be seen in FIG. 2 that the angle iron members 40*a* and 42*a* which extend in the direction of support rods 72 prevent the use of support rods along the corresponding edges of the expanded metal member 62. Accordingly, in order to provide sufficient compression of mats 64 and 66 for frictional engagement therebetween to hold mats 66 against dropping from the top wall assembly, flat sheets or blanket of fibrous insulating material 82 are interposed between frame members 40 and 42 and the mats 64 and 66 adjacent thereto. Preferably, for the purpose of preventing unintentional displacement of the mats 82 relative to the frame members and the adjacent mats 64 and 66, such as during handling of the top wall upon removal thereof, a plurality of spikes 84 are introduced through openings therefor in frame members 40 and 42 so as to penetrate sheets 82 and several of the mats 64 and 66.

The fibrous insulating material of mats 64 and 66 may shrink slightly during initial operation of the furnace after construction thereof, and the use of fibrous insulating material advantageously enables compensating for such shrinkage by introducing flat or folded sheets of the insulating material into areas of the wall assemblies such as at the tops of the back and side wall assemblies and in the areas of sheets 82 of the top wall assembly. The construction of the wall assemblies with the mats compressed transverse to the planes thereof as mentioned hereinabove also serves to provide compensation for shrinkage and, preferably, potential shrinkage is further compensated for by compressing the adjacent rows of mats in the direction of the axes of the support rods 72.

In the embodiment illustrated, furnace 10 includes a heat shield 90 supported outwardly of the front of the furnace and which heat shield is of a construction which minimizes the weight thereof and thus facilitates manipulation and removal thereof. In this respect, heat shield 90 is comprised of a peripheral frame defined by top and bottom angle iron members 92 and 94, respectively, and side angle iron members 96 and 98 at the opposite ends of the top and bottom members and suitably interconnected therewith such as by welding. The frame further includes intermediate support plate members 100 between and welded to the top and bottom members. A sheet of open metal mesh material 102, preferably an expanded sheet metal member similar to members 62 of the wall assemblies of the furnace, is received within the periphery of the heat shield frame and is secured thereto such as by welding to the underlying flanges of the angle iron frame members. One or more mats of fibrous insulating material 104 overlie expanded metal member 102, and the mats are held in place with respect to the heat shield frame such as by means of an open metal mesh member 106 on the inner side of the frame and having its peripheral edges secured such as by bolting to the edges of the flanges of the frame members. The function of member 106 is merely to retain mats 104 against member 102 and, accordingly, member 106 may be an expanded sheet metal member of lighter gauge material than member 102 or may be defined by wire screen material.

In accordance with another aspect of the present invention, and as best seen in FIGS. 2 and 4, the front wall of the furnace is defined by cast lintel blocks 108 of refractory material supported above the floor of the furnace by refractory bricks 110 to define openings 112 into the furnace chamber. The use of fibrous insulating material advantageously enables the use of vertically shorter lintels than heretofore required. The space between the tops of blocks 108 and top wall assembly 60 is filled with U-shaped mats 64 and 66 of fibrous insulating material structurally interleaved with one another as described hereinabove with regard to the back wall, side wall and top wall assemblies of the furnace. The mats 64 and 66 above lintel blocks 108 are inwardly adjacent furnace frame member 30 and are retained against lateral inward displacement relative to the furnace chamber by means of a plurality of wire staves 114 spaced apart along the length of frame member 30 and clampingly engaged between the flanges of frame members 30 and 40. Staves 114 have inner ends **114*a* penetrating and extending downwardly through several of the mats 64 and 66 and outer ends 114*b* extending downwardly across the outer edge of the upper flange of frame member 30, whereby the staves and thus the mats of insulating material are retained against the inner side of frame member 30**.

The lintel in a furnace is generally directly exposed to heat within the furnace chamber. This, together with the massiveness of the lintel and the high heat retention characteristic thereof, directly effects the time required to heat the furnace chamber to an operating temperature upon start up and to cool the chamber upon shut down. The use of mats of fibrous insulating material according to the present invention advantageously enables insulating the inner sides of the lintel blocks to minimize heating thereof during furnace operation, thus to reduce both the heating up and cooling down times for the furnace. More particularly in this respect, as best seen in FIGS. 2 and 3 of the drawing, the lowermost mats of insulating material overlying lintel blocks 108, designated by numeral 116, are U-shaped mats having parallel juxtaposed outer leg portions **116*a* between the upper sides of blocks 108 and the undersides of mats 64 and 66, and parallel juxtaposed inner legs 116*b* extending downwardly along the inner sides of blocks 108 and having an integral bridging portion 116*c* therebetween and adjacent the lower ends of the lintel blocks. Legs 116*b* may be bonded to one another and/or to the inner sides of blocks 108**, if desired, to assure retention of the inner ends of the mats against the lintel blocks.

In accordance with yet another aspect of the invention, as best seen in FIGS. 2 and 4 of the drawing, openings 112 into the furnace chamber are defined by the undersides of lintel blocks 108 and the upper side of sill plates 118 of refractory brick material overlying the upper surface of the furnace floor refractory material 26. Sill members 118 extend between support bricks 110 for the lintel blocks and have corresponding outer edges 118 and inner edges **118*b*. The floor of the furnace chamber for supporting workpieces to be heated is preferably defined by a granular refractory material 120, such as dolomite, which covers refractory material 26 inwardly of inner edges 118*b* of the sill members and the inner sides of support bricks 110. Sill members 118 have a vertical thickness which provides for furnace openings 112 to have a desired maximum vertical dimension, and the sill members are retained against lateral outward displacement from the furnace by an angle iron retaining member 122 overlying the upper flange of frame member 14. Retaining member 122 extends across the front of the furnace for the upright flange of the retaining member to engage outer ends 118*a* of the sill members. Retaining member 122 is removably interconnected with frame member 14, such as by means of a plurality of bolts 124, and removal of the retaining member provides access to the outer ends of sill members 118. Such access facilitates introducing suitable shims between the sill members and the underlying refractory material 26 to elevate the sill members and thus reduce the vertical heights of openings 112. Once the shims have been introduced beneath sill members 118, retaining member 122 is remounted on flange member 14 to engage the outer ends of the sill members against outward displacement relative to the furnace. The vertical heights of openings 112 can of course be reduced by a dimension corresponding to the height of the upright flanges of retaining member 122 without eliminating the retention capabilities thereof. It will be appreciated too that the vertical heights of openings 112 can be reduced beyond the dimension corresponding to the upright flange of retaining member 122 by introducing spacers between the retaining member and the underlying flange of frame member 14**, thus to elevate the retaining member.

The adjustment capability for furnace openings 112 provided as described above advantageously enables sealing the line of juncture between lintel blocks 108 so as to eliminate a potential leakage path thereacross, and in a manner which positionally stabilizes the blocks relative to the furnace chamber and frame assembly. In this respect, the furnace openings can be adjusted without disturbing the positions of the lintel blocks to achieve such adjustment, whereby it is not necessary to provide for the lintel blocks to be displaceable relative to one another and to the frame and furnace bed structure once the blocks are installed. Accordingly, as shown in FIG. 7 of the drawing, the lintel blocks can be cast for the vertical, adjacent inner side edges thereof to have opposed recesses 126 providing a vertical opening coextensive with the vertical height of the blocks which, when the blocks are in place, is filled with a cement material 128 which bonds with the blocks 108 to positionally stabilize the blocks and seal the joint across the inner side edges thereof.

As an example of the wall assemblies of a furnace constructed in accordance with the present invention and having a furnace chamber three feet high, three feet wide front to back, and six to ten feet wide side to side, the open metal mesh members 62 for the back, side and top wall assemblies can be defined by one-quarter to three-eighths inch unflatted expanded steel sheet, and mats 64 and 66 provide an insulating thickness of about one foot inwardly of the corresponding expanded metal member. Support rods 72 for mats 64 are three-sixteenth inch diameter steel rods, and tie wires 74 are of annealed steel alloy. A suitable insulating material for mats 64, 66, 82, 104 and 116 is a flexible ceramic fiber blanket material available from the Carborundum Company of Niagara Falls, New York under the latter's trademark Durablanket. The latter blanket material is available in a variety of thicknesses, and in the preferred embodiment herein disclosed, the flat insulating material employed has a thickness of one inch. Furthermore, this fibrous insulating material is available in two grades varying in thermal conductivity and, in connection with a preferred wall construction in accordance with the present invention, this enables realizing a savings in construction costs while maintaining a desired efficiency with respect to heating within the furnace chamber. In this respect, the insulating material having the higher thermal conductivity is less expensive than that of lower thermal conductivity, whereby considerable savings can be realized by providing for the U-shaped mats 64 to be comprised of the higher thermal conductivity material and the mats 66 of the lower thermal conductivity material, the latter being directly exposed to the heat within the furnace chamber so as to optimize heat retention in the chamber. Mats 116 overlying the inner sides of lintel blocks 108 preferably are of the lower thermal conductivity material, and mats 82 at the front and rear ends of the top wall assembly can be of the lower thermal conductivity material as can the mats 104 on heat shield 90.

In connection with the foregoing description and the appended claims, it will be understood that the use of the term wall is intended to be inclusive of front, back, side bottom and top walls for heating chambers as well as removable covers for heating chambers such as soaking pits. Moreover, while considerable emphasis has been placed herein on the structure of the preferred embodiment, it will be appreciated that many changes can be made therein without departing from the principles of the present invention. In this respect, for example, while it is preferred to use expanded sheet metal to provide the open metal mesh members for the wall assemblies, it will be appreciated that the function thereof could be provided by other structures providing an open mesh arrangement, such as a screen of wire of sufficient gauge to provide the necessary structural integrity for the wall assembly. Likewise, it will be appreciated that the support rod by which the mats of insulating material are supported on the metal mesh members could be other than circular in cross-section, could be hollow as opposed to solid, and could be interconnected with the corresponding metal mesh member other than by tie wires. These and other modifications of the preferred embodiment will be obvious and suggested to those skilled in the art from the foregoing description of the preferred embodiment, whereby it is to be distinctly understood that the descriptive matter herein is to be interpreted merely as illustrative of the present invention and not as a limitation.

Having thus described the invention, it is claimed:

1. A wall construction for a heating chamber comprising, open metal mesh means providing an exposed outer wall surface for said heating chamber and having outer and inner sides said metal mesh means having pairs of parallel spaced apart edges, mat means of fibrous insulating material covering said inner side of said metal mesh means between said pairs of edges, said mat means including U-shaped sections having parallel legs and an integral bridging portion therebetween, said bridging portions facing said inner side of said metal mesh means and said legs extending inwardly from said inner side of said metal mesh means and between one of said pairs of edges thereof in parallel relationship with respect to one another, support rod means extending between said one pair of edges of said metal mesh means and between the legs of said U-shaped sections adjacent said bridging portion therebetween, and a plurality of fastener elements spaced apart along said support rod means and connecting said support rod means to said metal mesh means, each said fastener element having an inner end extending around said support rod means and an outer end interengaged with said metal mesh means.

2. A wall construction for a heating chamber comprising, frame means including pairs of parallel spaced apart frame members, open metal mesh means providing an outer wall surface and having outer and inner sides, said metal mesh means having peripheral edge means secured to said frame means, a plurality of U-shaped mats of fibrous insulating material having parallel legs and an integral bridging portion therebetween, the planes of said legs being perpendicular to one of said pairs of frame members and said mats extending between said one pair of frame members in parallel relationship with respect to one another and with the bridging portions thereof abutting said inner side of said metal mesh means, said legs of said mats having inner ends spaced inwardly from said inner side of said metal mesh means, support rod means extending between said one pair of frame members and between the legs of said mats adjacent the bridging portions therebetween, and a plurality of fastening means spaced apart along said support rod means and directly connecting said support rod means to said metal mesh means, said fastening means including a plurality of wire elements each having an inner end extending around said support rod means and outer end means interengaged with said metal mesh means.

3. A wall construction according to claim 2, wherein each of said wire elements is U-shaped, the bight of the U providing said inner end and the legs of the U providing said outer end means, the legs of each wire element extending through said metal mesh means and being twisted together on the outer side thereof.

4. A wall construction according to claim 2, wherein said metal mesh means includes expanded sheet metal means.

5. A wall construction according to claim 2, wherein each said mat is coextensive with the corresponding support rod means in the direction between said one pair of frame members.

6. A wall construction for a furnace chamber comprising, open metal mesh means providing an outer wall surface having outer and inner sides, a plurality of first U-shaped mats of fibrous material having parallel legs and an integral bridging portion therebetween, said first mats being disposed in parallel juxtaposed relationship with respect to one another and with the bridging portions thereof abutting said inner side of said metal mesh means, said legs of said first mats having inner ends spaced inwardly from said inner side of said metal mesh means, a plurality of second U-shaped mats of fibrous insulating material having parallel legs and an integral bridging portion therebetween, said second mats being disposed with the bridging portions thereof extending across the inner ends of adjacent legs of adjacent ones of said first mats with the legs of said second mats receiving said adjacent legs therebetween and extending toward the bridging portions of said adjacent ones of said first mats, support rod means extending between the legs of said first mats adjacent the bridging portions therebetween, and fastening means fastening said support rod means to said metal mesh means, said fastening means including a plurality of wire elements each having an inner end extending around said support rod means and outer end means interengaged with said metal mesh means.

7. A wall construction according to claim 6, wherein said metal mesh means includes expanded sheet metal means.

8. A wall construction according to claim 6, wherein the thermal conductivity of the insulating material of said second mats is lower than that of the material of said first mats.

9. A wall construction according to claim 6, wherein said rod means includes a plurality of parallel rods each having axially opposite ends, said first and second mats being coextensive with said rods between said opposite ends.

10. A furnace chamber comprising upright front and back walls, upright side walls between said front and back walls, a bottom wall, and a top wall, said back wall and said side walls each including open metal mesh means providing an outer wall surface and pluralities of first and second U-shaped mats of fibrous insulating material supported on said metal mesh means and providing an inner surface for the corresponding wall, each said first and second mats having planar parallel legs and an integral bridging portion therebetween and said parallel legs having ends spaced from said bridging portion, said first mats being disposed in parallel juxtaposed relationship with respect to one another and with the bridging portions thereof abutting the corresponding metal mesh means, whereby the ends of the legs of said first mats are spaced from said corresponding metal mesh means, said second mats being disposed with the bridging portions thereof extending across the ends of adjacent legs of adjacent ones of said first mats with the legs of said second mats receiving said adjacent legs therebetween and extending toward the bridging portions of said adjacent ones of said first mats, support rod means extending between the legs of said first mats adjacent the bridging portions thereof, and fastening means fastening said support rod means to the corresponding metal mesh means, said fastening means including a plurality of wire elements each having an inner end extending around said support rod means and outer end means interengaged with said metal mesh means.

11. A furance chamber according to claim 10, wherein said front wall includes lintel means supported on said bottom wall between said side walls and having an upper surface underlying and spaced below said top wall, and a plurality of third mats of fibrous insulating material between said upper surface and said top wall.

12. A furnace chamber according to claim 11, wherein said lintel means has an inner surface extending downwardly from said upper surface, and at least one of said third mats extending downwardly along said inner surface.

13. A furnace chamber according to claim 10, wherein the thermal conductivity of the insulating material of said second mats is lower than that of the material of said first mats.

14. A furnace chamber according to claim 10, wherein said top wall includes open metal mesh means and pluralities of first and second U-shaped mats of fibrous insulating material supported thereon and interrelated therewith and with one another in the same manner as said rear wall and said side walls.

15. A furnace chamber according to claim 14, wherein the thermal conductivity of the insulating material of said second mats is lower than that of the material of said first mats.

16. A furnace chamber according to claim 10, wherein said bottom wall includes refractory brick means having a top surface and said front wall includes lintel means between said side walls and having a bottom surface spaced above said top surface of said brick means, said bottom wall further including sill means of refractory material resting on said top surface of said refractory brick means and having a top surface spaced below said bottom surface of said lintel means and providing therewith an opening into said chamber, frame member means extending along said refractory brick means between said side walls and adjacent said top surface of said refractory brick means, said sill means having an outer edge adjacent said frame member means, and retainer member means removably fastened to said frame member means and engaging said sill means against displacement outwardly with respect to said opening into said chamber and, upon removal from said frame member means, providing access to said outer edge of said sill means.

17. A furnace chamber according to claim 10, wherein said rod means of each said back and side walls includes a plurality of vertically spaced apart horizontal rods, and said pluralities of first and second mats on said meal mesh means of each said back and side walls includes a plurality of vertical rows of first and second mats disposed in horizontally side by side juxtaposed relationship.

18. A furnace chamber according to claim 17, wherein the thermal conductivity of the insulating material of said second mats is lower than that of the material of said first mats.

19. A furnace chamber according to claim 18, wherein said top wall includes open metal mesh means and pluralities of first and second U-shaped mats of fibrous insulating material supported thereon and interrelated therewith and with one another in the same manner as said rear wall and said side walls.

20. A furnace chamber comprising upright front and back walls, upright side walls between said front and back walls, a bottom wall, and a top wall, said back wall and said side walls each including open metal mesh means providing an outer wall surface and pluralities of first and secod U-shaped mats of fibrous insulating material supported on said metal mesh means and providing an inner surface for the corresponding wall, each said first and second mats having planar parallel legs and an integral bridging portion therebetween and said parallel legs having ends spaced from said bridging portion, said first mats being disposed in parallel juxtaposed relationship with respect to one another and with the bridging portions thereof abutting the corresponding metal mesh means, whereby the ends of the legs of said first mats are spaced from said corresponding metal mesh means, said second mats being disposed with the bridging portions thereof extending across the ends of adjacent ones of said first mats with the legs of said second mats receiving said adjacent legs therebetween and extending toward the bridging portions of said adjacent ones of said first mats, support rod means extending between the legs of said first mats adjacent the bridging portions thereof, fastening means fastening said support rod means to the corresponding metal mesh means, and said upen metal mesh means of each said side wall being perpendicular to said open metal mesh means of said back wall providing corners therebetween perpendicular to the planes of the legs of said first and second mats of said back and side walls, said first and second mats on said metal mesh means of said back wall and side walls extending into said corners and having cooperatively contoured interengaging recesses parallel to the metal mesh means of said back and side walls.

21. A wall construction for a heating chamber comprising, open metal mesh means providing an exposed outer wall surface for said heating chamber and having outer and inner sides, said metal mesh means having pairs of parallel spaced apart edges, mat means of fibrous insulating material covering said inner side of said metal mesh means between said pairs of edges, said mat means including U-shaped sections having parallel legs and an integral bridging portion therebetween, said bridging portions facing said inner side of said metal mesh means and said legs extending inwardly from said inner side of said metal mesh means and between one of said pairs of edges thereof in parallel relationship with respect to one another, support rod means extending between said one pair of edges of said metal mesh means and between the legs of said U-shaped sections adjacent said bridging portion therebetween, and a plurality of fastening means spaced apart along said support rod means and connecting said support rod means to said metal mesh means, said fastening means including a plurality of wire elements each having an inner end extending around said support rod means and outer end means interengaged with said metal mesh means.

22. A wall construction according to claim 21, wherein said legs of said U-shaped sections have inner ends spaced inwardly from said inner side of said metal mesh means, and second mat means of fibrous insulating material, said second mat means including second U-shaped sections having parallel legs and an integral bridging portion therebetween, said legs of said second U-shaped sections being interleaved with said legs of the first named U-shaped sections and said bridging portions of said second U-shaped sections covering said inner ends of said legs of said first named U-shaped sections.

23. A wall construction according to claim 22, wherein the insulating material of the first named mat means has a given thermal conductivity, and the insulating material of said second mat means has a thermal conductivity lower than said given thermal conductivity.

24. A wall construction according to claim 23, wherein said bridging portions of said second U-shaped sections extend across said inner ends of adjacent legs of adjacent ones of said first named U-shaped sections with the legs of said second U-shaped sections receiving said adjacent legs therebetween.

* * * * *